US009554601B2

(12) United States Patent
Arajakis

(10) Patent No.: US 9,554,601 B2
(45) Date of Patent: Jan. 31, 2017

(54) CONVERTIBLE GARMENT AND A BAG

(71) Applicant: GamePlan Gear LLC, Dubuque, IA (US)

(72) Inventor: Michael M. Arajakis, Boardman, OH (US)

(73) Assignee: GamePlan Gear LLC, Dubuque, IA (US)

( * ) Notice: Subject to any disclaimer, the term of this patent is extended or adjusted under 35 U.S.C. 154(b) by 277 days.

(21) Appl. No.: 14/271,322

(22) Filed: May 6, 2014

(65) Prior Publication Data

US 2014/0331381 A1 Nov. 13, 2014

Related U.S. Application Data

(60) Provisional application No. 61/820,343, filed on May 7, 2013.

(51) Int. Cl.

| | |
|---|---|
| ***A41D 15/00*** | (2006.01) |
| ***A41D 3/00*** | (2006.01) |
| ***A41D 15/04*** | (2006.01) |
| ***A45F 4/12*** | (2006.01) |

(52) U.S. Cl.

CPC ..... *A41D 3/005* (2013.01); *A41D 15/04* (2013.01); *A45F 4/12* (2013.01); *A41D 2200/20* (2013.01); *A41D 2300/322* (2013.01)

(58) Field of Classification Search

CPC .. A41D 1/04; A41D 13/0012; A41D 13/0058; A41D 15/00; A41D 15/04; A41D 27/20–27/208; A41D 2400/12; A41D 2600/108

USPC ..... 2/69

See application file for complete search history.

(56) References Cited

U.S. PATENT DOCUMENTS

| | | | | | |
|---|---|---|---|---|---|
| 859,277 | A | * | 7/1907 | Woodworth | 2/250 |
| 1,212,513 | A | * | 1/1917 | Langerman | 2/94 |
| 1,309,783 | A | * | 7/1919 | Slawin | 2/206 |
| 1,970,110 | A | * | 8/1934 | Vaccaro | 2/247 |
| 1,982,100 | A | * | 11/1934 | Heile | 2/253 |
| 2,066,072 | A | * | 12/1936 | Powell | 2/51 |
| 2,500,982 | A | * | 3/1950 | Fligel | 2/84 |
| 2,591,059 | A | * | 4/1952 | Frohman | 2/247 |
| 2,919,443 | A | * | 1/1960 | Kashiyama | 2/94 |
| 2,959,789 | A | * | 11/1960 | Mills et al. | 2/93 |
| 3,529,307 | A | * | 9/1970 | Belson et al. | 2/94 |
| 3,561,010 | A | * | 2/1971 | Little | 2/173 |
| 3,950,789 | A | * | 4/1976 | Konz et al. | 2/93 |
| 4,057,854 | A | * | 11/1977 | Phelps, Sr. | 2/128 |

(Continued)

FOREIGN PATENT DOCUMENTS

| | | |
|---|---|---|
| EP | 0269578 | 6/1988 |
| KR | 100920460 | 10/2009 |

OTHER PUBLICATIONS

International Search Report for PCT/US2014037016 dated May 6, 2014.

*Primary Examiner* — Khaled Annis

(74) *Attorney, Agent, or Firm* — Rathe Lindenbaum LLP

(57) ABSTRACT

A garment comprises a body having a waist area with a waist opening and a chest area with a head opening; sleeves extending from the body; a hood extending from the body about the head opening and having a face opening; and a waist opening closer on a lower portion of the waist area to retain opposite sides of the waist opening in contact so as to form a floor of a bag with the waist area of the body.

23 Claims, 4 Drawing Sheets

(56) References Cited

U.S. PATENT DOCUMENTS

| | | | | | |
|---|---|---|---|---|---|
| 4,062,064 | A | * | 12/1977 | Vosatka | 2/252 |
| 4,067,066 | A | * | 1/1978 | Bruno | 2/105 |
| 4,095,290 | A | * | 6/1978 | O'Brien | 2/9 |
| 4,347,629 | A | * | 9/1982 | Itoi | 2/108 |
| 4,476,587 | A | * | 10/1984 | Itoi | 2/94 |
| 4,497,071 | A | * | 2/1985 | Bell | 2/94 |
| 4,586,506 | A | * | 5/1986 | Nangle | 607/112 |
| 4,637,075 | A | * | 1/1987 | Ingrisano et al. | 2/94 |
| 4,768,235 | A | * | 9/1988 | Webster | 2/205 |
| 4,941,211 | A | * | 7/1990 | Blutstein | 2/202 |
| 5,075,900 | A | * | 12/1991 | Chittenden | 2/94 |
| 5,165,115 | A | * | 11/1992 | Stanislaw | 2/247 |
| 5,278,998 | A | * | 1/1994 | Book | 2/102 |
| 5,351,675 | A | * | 10/1994 | Brodsky | 600/169 |
| 5,370,113 | A | * | 12/1994 | Parsons | 128/205.22 |
| 5,504,944 | A | * | 4/1996 | Bromer et al. | 2/269 |
| 5,546,604 | A | * | 8/1996 | Geller | 2/202 |
| 5,551,087 | A | * | 9/1996 | Blutstein et al. | 2/173 |
| 5,713,077 | A | * | 2/1998 | Humbrecht | 2/173 |
| 5,809,572 | A | * | 9/1998 | Sisolak | 2/173 |
| 5,845,340 | A | * | 12/1998 | Frislie | 2/202 |
| 5,850,634 | A | * | 12/1998 | Toombs | 2/93 |
| 5,940,883 | A | * | 8/1999 | Daoust | 2/102 |
| 6,397,395 | B1 | * | 6/2002 | DeHart | 2/206 |
| 6,449,772 | B1 | * | 9/2002 | Donner | 2/170 |
| 6,760,922 | B1 | * | 7/2004 | Morales | 2/94 |
| 6,971,566 | B1 | * | 12/2005 | Sartena | 224/576 |
| 6,996,847 | B2 | * | 2/2006 | Anderson et al. | 2/16 |
| 7,143,450 | B2 | * | 12/2006 | Green, III | 2/94 |
| 7,254,841 | B1 | * | 8/2007 | Nelson et al. | 2/102 |
| 7,739,748 | B2 | * | 6/2010 | Nilforushan et al. | 2/69 |
| 8,566,963 | B2 | * | 10/2013 | Ryan | 2/84 |
| 8,875,314 | B1 | * | 11/2014 | Panetta | 2/102 |
| 8,910,314 | B2 | * | 12/2014 | Hefter et al. | 2/69 |
| 2005/0160514 | A1 | * | 7/2005 | Flaniken | 2/84 |
| 2006/0117453 | A1 | * | 6/2006 | Hood | 2/69 |
| 2007/0118960 | A1 | * | 5/2007 | Goodwin | 2/84 |
| 2007/0226871 | A1 | * | 10/2007 | Hood | 2/69 |
| 2008/0067203 | A1 | * | 3/2008 | Culhane | 224/155 |
| 2008/0196140 | A1 | * | 8/2008 | Mayerson et al. | 2/84 |
| 2009/0094725 | A1 | * | 4/2009 | Smith et al. | 2/69 |
| 2009/0158493 | A1 | * | 6/2009 | Kim | 2/93 |
| 2009/0229034 | A1 | * | 9/2009 | Zmigrosky | 2/79 |
| 2010/0127025 | A1 | * | 5/2010 | Kelling | 224/153 |
| 2011/0139834 | A1 | * | 6/2011 | Joostberns | 223/111 |
| 2011/0185471 | A1 | * | 8/2011 | Buczkowski et al. | 2/84 |
| 2012/0005802 | A1 | * | 1/2012 | Claeys | 2/84 |
| 2013/0219581 | A1 | * | 8/2013 | Schrimpf | 2/69 |
| 2014/0331381 | A1 | * | 11/2014 | Arajakis | 2/84 |

* cited by examiner

CONVERTIBLE GARMENT AND A BAG

CROSS-REFERENCE TO RELATED PATENT APPLICATIONS

The present application is a non-provisional application claiming priority under 35 USC 119 from U.S. Provisional Patent Application Ser. No. 61/820,343 filed on May 7, 2013 by Michael J. Arajakis and entitled GARMENT, the full disclosure of which is hereby incorporated by reference.

BACKGROUND

Garments come in a variety of sizes, shapes and forms. One popular type of garment is a pullover garment, such as hooded sweatshirt. Such hooded sweatshirts provide a person with the option of raising or lowering a hood depending upon the weather or temperature.

DETAILED DESCRIPTION OF THE EXAMPLE EMBODIMENTS

Figure 1:
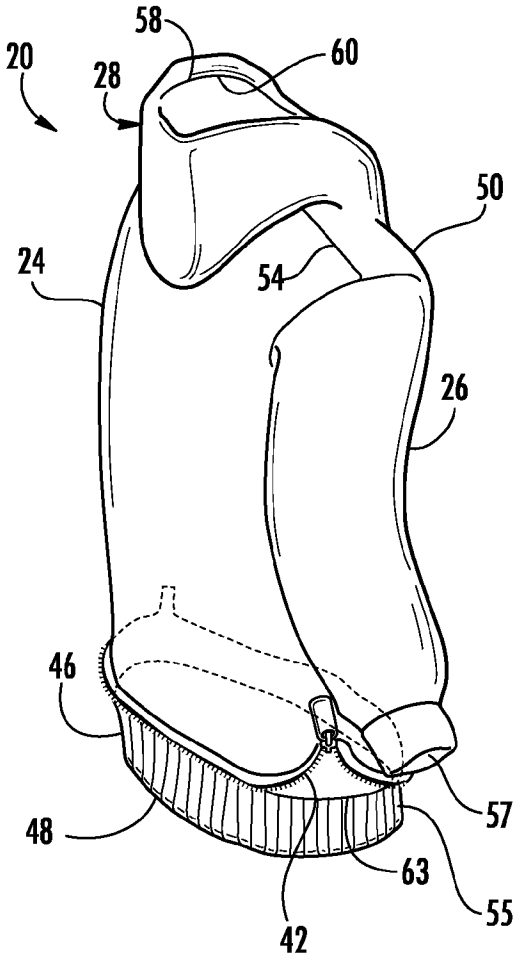
FIG. 1 is a rear perspective view of an example garment in a clothing state.
Figure 2:
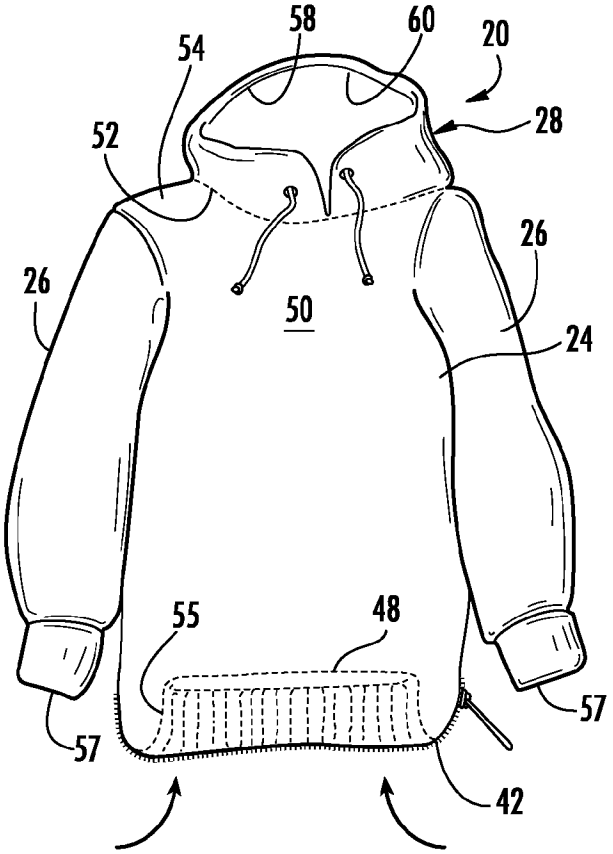
FIG. 2 is a front perspective view of the garment of FIG. 1 in a bag forming state.

FIGS. 1 and 2 illustrate an example garment 20. As will be described hereafter, garment 20 provides enhanced versatility, facilitating use of garment 20 as a bag, pack or other article transporting carrier. Garment 20 is substantially formed from one or more materials such as cotton, polyesters or other breathable fabrics. In some implementations, garment 20 may alternatively be formed from water impermeable fabrics or layers or may include an outer water impermeable fabric or layer. Although garment 20 is illustrated as pullover garment, such as a hooded sweatshirt, wherein garment 20 is simply pulled over the head and body of the person while the person's arms are passed through sleeves in other implementations, garment 20 may have other configurations configured to be worn as a top garment with or without a hood. For purposes of this disclosure, the phrase "configured to" denotes an actual state of configuration that fundamentally ties the stated function/use to the physical characteristics of the feature proceeding the phrase "configured to".

As shown by FIG. 1, garment 20 comprises garment 20 comprises body 24, sleeves 26, hood 28 and waist opening closer 42. Body 24 comprises a main portion of garment 20 configured to overlie or cover a person's waist, chest, back and shoulders. In one implementation, body 24 comprises multiple layers sewn or attached to one another.

In another implementation, body 24 may comprise a single layer of fabric or material. Body 24 has a waist area 46 with a waist opening 48 and a chest area 50 with a head opening 52. The front of body 20 and the rear body 24 are generally separated by an upper seam 54 which extends across the shoulders of a person wearing garment 20.

In the example illustrated, body 24 comprises a cuff 55. Cuff 55 comprises a band extending around a lower end of waist area 46 so as to define or border waist opening 48. As shown by FIGS. 1 and 2, cuff 55 is joined to a remainder of body 24 so as to be pivotable, foldable or movable between a downward extended position shown in FIG. 1 and an upward extending retracted or withdrawn position shown in FIG. 2. In the example illustrated, cuff 55 is withdrawn within an interior of body 24 and faces upwardly towards head opening 52 when in the withdrawn position shown in FIG. 2. In one implementation, cuff 55 is formed from an elastic material or include elastomeric material such that cuff 55 has elasticity similar to that of a waistband, wherein cuff 55 elastically stretches when receiving a person's anatomy so as to tightly wrap about or grip a person's anatomy are waist. As a result, cuff 55 provides a more secure or tight fit about a person's waist to retain the person's body heat for warmth. In the example illustrated, the elastic nature of cuff 46 further assists in maintaining cuff 55 in the raised or withdrawn position shown in FIG. 2, facilitating enhanced performance of waist opening closer 42. In other implementations, cuff 55 is not be elastic, but comprises an internal drawstring by which the inner diameter of cuff 48 may be reduced for secure fit about a person's waist. In yet other implementations, cuff 55 omits a diameter reducing mechanism, such as an internal elastic band or a drawstring. In still other implementations, cuff 55 may be omitted.

Sleeves 26 comprise tubular structures extending from body 24 for reception of a person's arms. In the example illustrated, sleeves 26 terminate at sleeve openings 57 which are to extend about a person's wrist. In some implementations, sleeves 26 may comprise short sleeves, terminating a sleeve opening 57 about a person's upper arm. Still other implementations, sleeves 26 are omitted.

Hood 28 extends from body 24 about head opening 52. In one implementation, hood 28 is permanently joined to or fastened to body 20 about head opening 52 along a sewn seam. Hood 28 has a face opening 58 opening to an interior 60 of hood 28. Although illustrated as completely surrounding face opening 58, in other implementations, hood 28 may alternatively partially surround face opening 58, wherein an upper portion of head opening 52 extends along a lower edge of face opening 58. In some implementations, hood 28 may be releasably fastened to body 28 by a zipper, snaps or the like. In some implementations, hood 28 may be formed from one or more materials or fabric layers that are different from the layers or fabric materials of body 20. In some implementations, hood 28 may be omitted.

Waist opening closer 42 comprise a mechanism configured to close waist opening 48, facilitating use of garment 20 as a bag. Waist opening closer 42 is located proximate to waste opening 48 to retain opposite sides of waste opening 48 in contact so as to form a floor of a bag with the waist area of body 20. In the example illustrated, waist opening closer 42 comprises a zipper sewn across a bottom of the garment, allowing garment 20 to carry gear or extra clothing when not being worn. As compared to a drawstring, such a zipper reliably retains the opposite sides of waste opening 48 in interlocking or interleaving cooperative engagement with one another. For example, in one implementation, waist opening closer 42 comprises a zipper, zip, fly or zip fastener (sometimes referred to as a clasp locker) having two rows of protruding teeth which interdigitate and intermesh with one another in response to movement of a zipper slider when closing waist opening 48. In another implementation, waist opening closer 42 comprises a ZIPLOC brand type plastic zipper in which a bulbous strip (or single tooth) is interlocked or intermeshed with a corresponding elongate groove (or pair of teeth) in response to movement of a slider or being pinched together by a person's fingers. Examples of different types of zippers that may be employed for waist opening closer 42 include, but are not limited to, coil zippers, invisible zippers, reverse coil zippers, metallic zippers, plastic molded zippers, open-ended zippers, closed ended zippers and magnetic zippers. With such zippers, the closure of opening 48 is complete, reducing a likelihood of articles and wait exerting a force so as to widen any remaining opening allowing articles to slip through such an opening when garment 20 is utilized as a bag. Moreover, as compared to a drawstring, in implementations where waste opening closer 42 comprises a zipper, waist opening closer 42 avoids an excessively large string or tail hanging from garment 20 when waist opening closer 42 is in a closed state closing waist opening 48. In other implementations, waist opening closer 42 may comprise other closing mechanism such as snaps, buttons, hooks, or a drawstring.

As shown by FIG. 1, in the example illustrated, waist opening closer 42 (shown as zipper with alternating interlocking teeth) extends about waist portion 46 above cuff 55. In the example illustrated, waist opening closer 42 extends at or above the fold line or seam 63 joining cuff 55 to a remainder of body 24 and about which cuff 55 pivots between the extended position shown in For 1 and the withdrawn position shown in FIG. 2. As a result, when cuff 55 is in the extended position shown in FIG. 1, cuff 55 separates the teeth of waste opening closer 42 from the person's skin or any undergarment over which garment 20 is worn. As a result, the teeth of waste opening closer 42 are less likely to catch or abrade upon the person skin or any undergarment. At the same time, as shown by FIG. 2, when cuff 55 is moved to the withdrawn position, cuff 55 is completely contained within the interior of body 24 above waist opening closer 42.

In some implementations, cuff 55 is formed from an elastic, but water absorbent fabric or material distinct from an inelastic or less elastic waterproof or water resistant material on the outer surface of body 24. In some implementations, due to being formed from a material that is resilient or softer as compared to the material on the outer surface of the remainder of garment 20, cuff 55 may also have a greater susceptibility to catching, tearing or unraveling as compared to the material forming the remainder of the outer surface of garment 20. In such implementations, because cuff 55 is completely contained within the interior of body 24 when garment 20 is being utilized as a bag, cuff 55 is less likely to absorb moisture or water and is protected from tearing, staining or discoloration.

Figure 3:
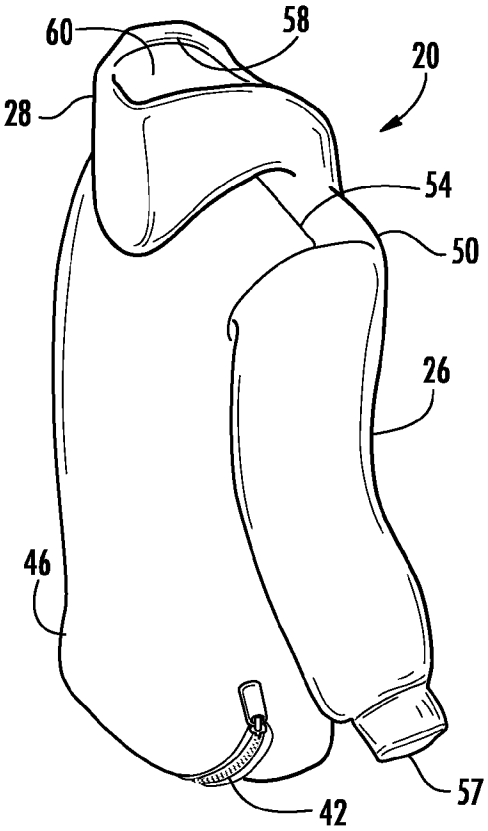
FIG. 3 is a rear perspective view of the garment of FIG. 2.
Figure 4:
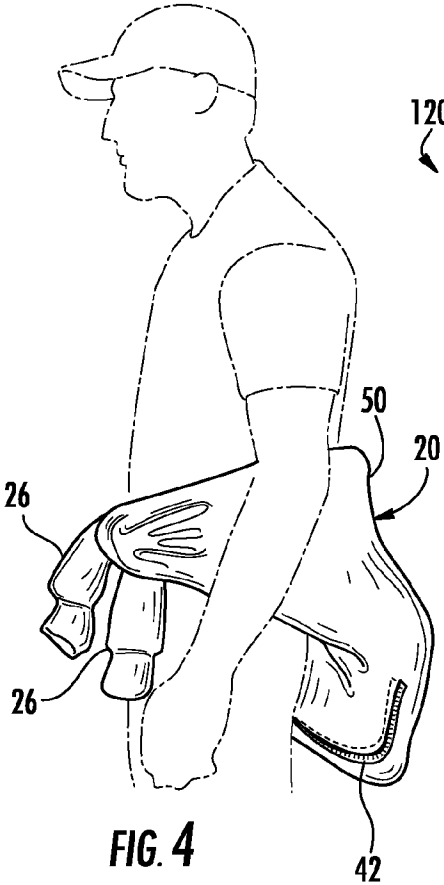
FIG. 4 the front perspective view of the garment of FIG. 2 in a bag forming state while being worn about a waist of a person.

FIGS. 3 and 4 illustrate garment 20 in a bag forming state. FIG. 3 illustrates garment 20 with waist opening closer 42 in a closed state. In the example illustrated in which waist opening closer 42 comprises a zipper, FIG. 3 illustrates the zipper in a fully zipped up state. As a result, waist portion 46 above the zipper of waste opening closer 42 now forms a floor or bottom of her receptacle, pack or bag. The interior of the formed bag may be loaded with articles through face opening 58 of hood 28 and through head opening 52. As shown by FIG. 4, sleeves 26 may be wrapped around the waist of the person and tied, freeing both arms of the person while on the person carried the contents of garment 20 behind his or her back.

Figure 5:
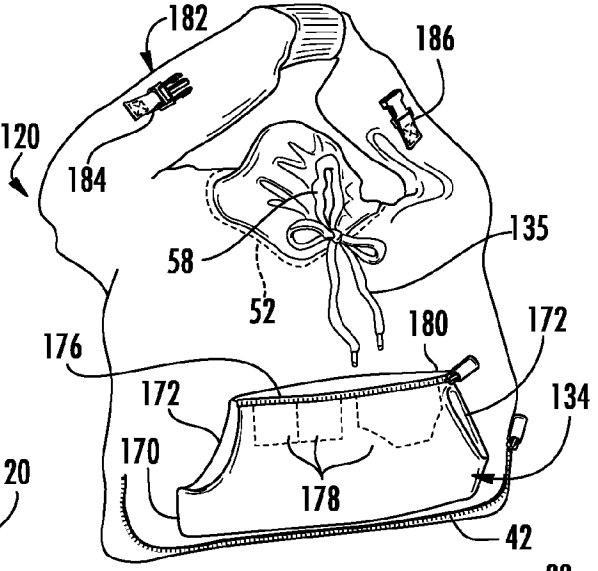
FIG. 5 is a front perspective view of an example implementation of the garment of FIG. 1 in a bag forming state.

FIGS. 5-9 illustrate garment 120, an example implementation of garment 20. Garment 120 is similar to garment 20 in that garment 120 comprises body 24, sleeves 26, hood 28 and waist opening closer 42, each of which is described above. FIG. 5 illustrates a front of garment 120 with waist opener closer 42 (shown as a zipper) in the closed state similar to that shown in FIGS. 2 and 3 with respect to garment 20. In such a state, cuff 55 is bent inwardly an upwardly into the interior of garment 120 so as to form a bag.

Figure 8:
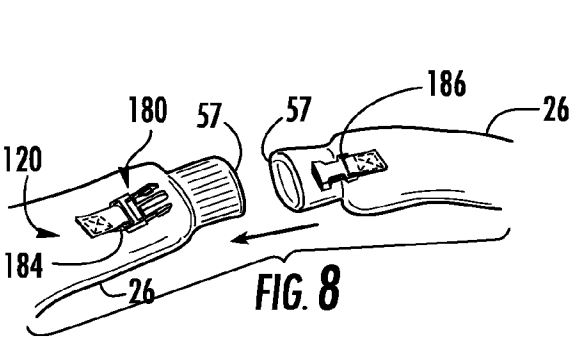
FIG. 8 is a fragmentary perspective view of a portion of the garment of FIG. 5 illustrating example sleeve connectors.

As further shown by FIG. 8, garment 120 additionally comprises kangaroo pocket 134 and face opening closer 135. Kangaroo pocket 34 is a double entry pocket located on waist area 46 of body 20. Although illustrated as having a lower receptacle portion 170 below pocket side openings 172, in other implementations, pocket 134 may alternatively comprise a horizontal tube or sleeve, wherein the bottom of the tube or sleeve serves as a pocket. In the example illustrated, pocket 134 comprises a top opening 176 providing access to the interior of pocket 134. In the example illustrated, garment 120 further comprises one or more upper gear pockets 178 which are contained within an interior of pocket 134 and have mouths facing upwardly which are accessible through top opening 176 of pocket 134. In the example illustrated, top opening 176 comprises a closing mechanism 180 to selectively opening close top opening 176. Although illustrated as a zipper, in other implementations, the closing mechanism 180 may comprise other closing mechanism such as a hook and loop fastener, button, snap or the like. In some implementations, top opening 176 and/or upper pockets 178 may be omitted.

Figure 6:
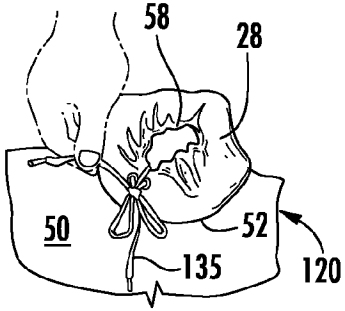
FIG. 6 is an enlarged view of the garment of FIG. 5 illustrating closure of a face opening.

Face opening closer 135 comprises a mechanism to selectively opening close face opening 58. As shown by FIG. 6, once waist opening closer 42 has closed waist opening 48, articles may be loaded into the thus formed bag through face opening 58 52. Thereafter, face opening closer 135 may be drawn or otherwise closed secure the contents in place.

In the example illustrated, face opening closer 135 comprises a drawstring that extends through and along a sleeve along the perimeter of face opening 58. In other implementations, face opening closer 135 may comprise a zipper, one or more hook and loop fasteners, one or more buttons, snaps or the like. As shown by FIG. 6, when garment 120 is utilized in a bag forming state in which waist opening closer 42 is in a closed state, face opening closer 58 may be utilized to close face opening 58 to further assist in retaining articles within the interior of garment 120. In other implementations, face opening closer 58 may be omitted.

Figure 9:
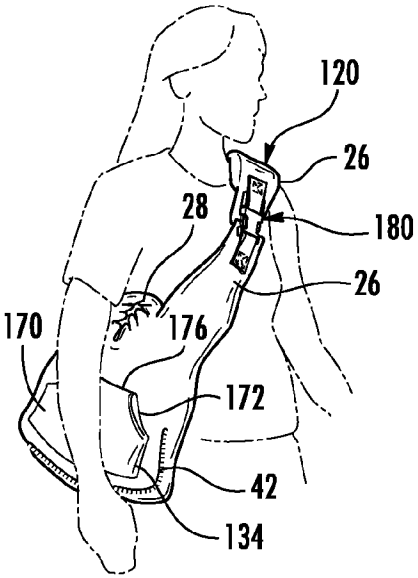
FIG. 9 is a perspective view of the garment of FIG. 5 in the bag forming state while being worn over a shoulder of a person.
Figure 7:
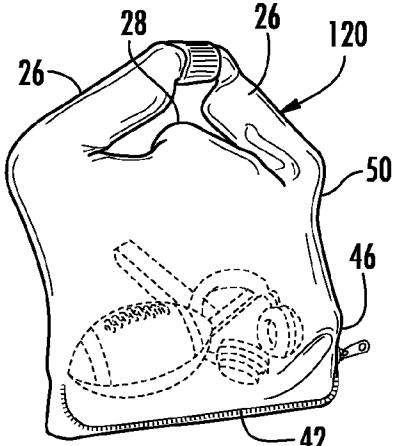
FIG. 7 is a rear perspective view of the garment of FIG. 5 in the bag forming state while carrying articles or items.

As shown by FIG. 8, garment 120 additionally comprises sleeve connectors 180, 182. Sleeve connector 180 comprises one or more mechanisms are structured which cooperate to releasably secure and retain and portions of sleeves 26 in a connected state such that the two sleeves, when connected, form a band or strap. Sleeve connector 180 is located proximate to the ends of sleeves 26 to facilitate the formation of a band or strap using sleeves 26 to permit garment 120 being worn about a person's waist as seen in FIG. 4 or over a shoulder as seen in FIG. 9.

In one implementation, garment 120 may comprise multiple spaced sleeve connectors at different locations along sleeves 26 to form a strap of a selected length. For example, as shown by FIG. 5, garment 120 comprises a second sleeve connector 182 closer to the point where any sleeve 26 extends from body 24, such that when sleeves 26 are connected, sleeves 26 form a shorter strap, such as where garment 120 is to serve as a handbag carried by one's hand.

In the example illustrated, sleeve connectors 180, 182 each comprise a plastic side-release buckle having a male buckle portion 184 fastened to one of sleeves 26 in a female buckle portion 186 fastened to the other of sleeves 26. In one implementation, male buckle portion 184 and female buckle portion 186 are secured along and within the interior of sleeves 26. In yet another implementation, male buckle portion 184 and female buckle portion 26 are secured along an exterior of sleeves 26. In the example illustrated, the ends of the two sleeves are differently sized so as to facilitate the reception of one sleeve by the other sleeve. In yet another implementation, the end portions are collars of such sleeves are configured to be turned inwardly when sleeves 26 are to be used to form a strap. When turned inwardly, male buckle portion 24 and female buckle portion 26 are connectable to one another along an exterior of sleeves 26.

In other implementations, sleeve connectors 180, 182 may have other configurations to facilitate the releasable connection of sleeves 26 so as to form a strap, belt, band or loop. For example, in other implementations, sleeve connectors 180, 182 may comprise hook and loop fasteners, buttons, snaps, ring and carabiner connection mechanisms, clasps, belt buckles, snap fit buckles, a slide buckle and the like. For example, one of sleeves 26 may include a carabiner while the other of sleeves includes a ring about which the carabiner releasably snaps. In another implementation, one of sleeves 26 may comprise a buckle frame having a prong or the other sleeve 26 comprises belt having a plurality of spaced openings, wherein the belt slidably positionable through the buckle frame and were in the prong may be positioned within one of the spaced openings by one of a plurality of different available lengths for the strap formed by sleeves 26, facilitating a first length for a shoulder strap and a second shorter length for a hand carrying strap. In yet other implementations, one or both of connectors 180, 182 may be omitted.

Figure 10:
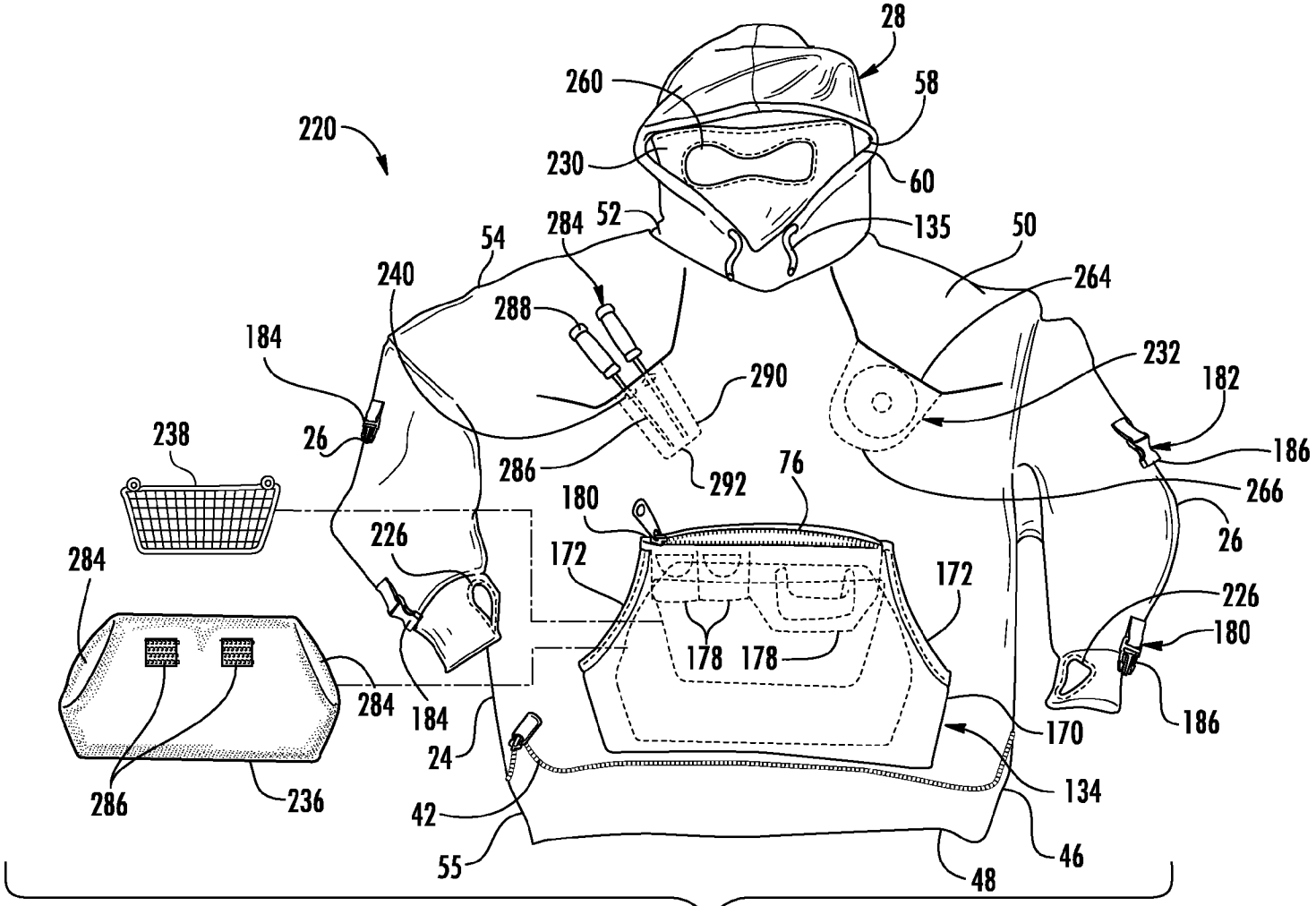
FIG. 10 is a front perspective view of another example implementation of the garment of FIG. 1.

FIG. 10 illustrates an example hunting garment 220, another implementation of garment 20. In the example illustrated, hunting garment 220 comprises a pullover garment, wherein garment 220 is simply pulled over the head and body of the person while the person's arms are passed through sleeves. Garment 220 lacks a shirt tail. In the example illustrated, garment 220 comprises what is sometimes referred to as a "hoodie". Garment 220 is substantially formed from one or more materials such as cotton, polyesters or other breathable fabrics. In some implementations, garment 220 may alternatively be formed from water impermeable fabrics or layers or may include an outer water impermeable fabric or layer. In the example illustrated, garment 220 has an outer surface or exterior that is either black in color, dark in color or provided with a camouflage appearance or pattern.

Garment 220 is similar to garment 20 in that garment 220 comprises body 24 including cuff 55, sleeves 26, hood 28 and waist opening closer 42, each of which is described above. Garment 220 is similar to garment 120 in that garment 220 additionally comprises kangaroo pocket 134, face opening closer 135 and sleeve connectors 180, 182, each of which is described above. As shown by FIG. 10, garment 220 additionally comprises thumb holes 226, face mask 230, pocket 232, hand warmer muff 236, hand warming packet carrier 238 and pot call striker peg holder 240.

Thumb holes 226 are located at an end portion of each of sleeves 26. Thumb holes 226 are located to receive a person's thumbs such that the end of the sleeves 26 may be retained over the palm and backside of the hunter's hands, allowing the hunter's fingers to extend beyond the end of sleeve 26 for use in manipulating hunting equipment. In one implementation, each opening 226 is surrounded by an elastic, wherein thumb hole 226 naturally closes when not receiving a hunter's thumb. In some implementations, thumb openings or holes 226 may be omitted.

Facemask 230 comprises a layer of fabric or other material extending from a remainder of garment 220 so as to at least partially block or overlie portions of a hunter's face that would otherwise be exposed through face opening 58. As noted above, facemask 230 is black, dark in color or provided with a camouflage outer appearance. Facemask 230 is connected to a remainder of garment 220. In one implementation, facemask 230 is welded, glued, sewn or otherwise fixed our permanently fastened to a remainder of garment 220. In another implementation, facemask 230 is releasably attached to garment 220 through the use of hook and loop fasteners, snaps, hooks, buttons, one or more zippers and the like.

In the example illustrated, facemask 230 comprises a tube connected to a rear internal surface of hood 28, wherein the tube is sized receive at least a portion of a person's head. In one implementation, the tube is elastic so as to stretch about a person's head to, a differently sized heads. In one implementation, an end portion of the tube is elastic. In the example illustrated, the tube includes an eye-opening 260 for alignment with a person's eyes to facilitate viewing through the tube forming facemask 230. In another implementation, the tube may include two separate eye-openings 260. In another implementation, such eye-openings 260 may be covered by perforated material or netting which allows viewing through the netting but which further blocks or conceals a person's eyes. In one implementation, a substantial portion of the tube forming facemask 230 may be formed from such see-through netting. In other implementations, the tube forming facemask 230 may alternatively be configured to terminate below a person dies, concealing the persons cheeks, mouth and possibly his or her nose.

Figure 11:
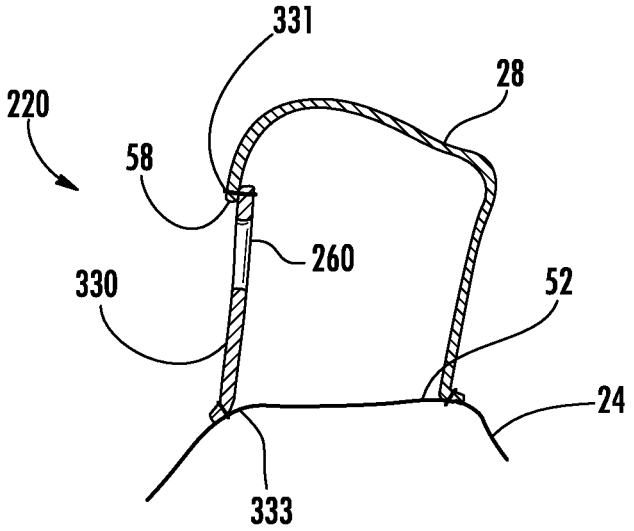
FIG. 11 is a fragmentary sectional view of another example implementation of the garment of FIG. 10.

In other implementations, facemask 230 may have other configurations. For example, as shown by FIG. 11, garment 220 may alternatively comprise a facemask 330 comprises a panel suspended from an upper portion of hood 28. Facemask 330 may be permanently fixed to or releasably attached to an upper portion of hood 28 proximate an upper end 331 of face opening 58. In one implementation, the lower portion panel forming facemask 330 is releasably attached to a lower portion of hood 28 or an upper portion of body 24, such as that location 333, by snaps, hook and loop fasteners, buttons, zippers and the like. When not being used, facemask 330 may either be positioned over a top and behind a person's head and neck or may be detached.

Figure 12:
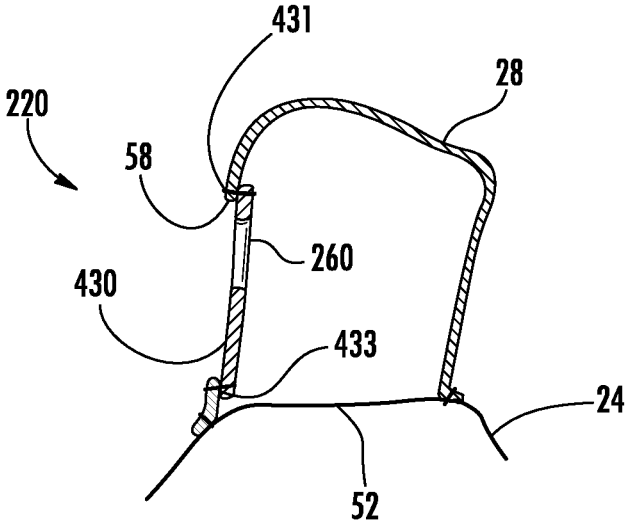
FIG. 12 is a fragmentary sectional view of another example implementation of the garment of FIG. 10.

As shown by FIG. 12, garment 220 may alternatively comprise a facemask 430 comprising a panel connected to garment 20 below face opening 58 at location 433. In such an implementation, an upper portion of the panel forming facemask 430 is releasably attached to upper end 431 of face opening 58 by snaps, hook and loop fasteners, buttons, zippers and the like. When not in use, facemask 430 may be positioned about a person's neck to insulate the person's neck, may be dropped into body 24 across the persons chest or may be detached (where detachment capability is provided). In some implementations, facemask 230, 330, 430 may be omitted.

Pocket 232 comprises an upwardly facing pocket located on the chest area 50 of body 20. Pocket 232 is located on chest area 50 so as to not interfere with a shouldered firearm or archery (below or crossbow) and so as to not interfere with positioning of a firearm or a crossbow stock against a hunter's shoulder. In the example illustrated, the upper end of pocket 232 (as defined by its upper opening or aperture 264) is at least 3 inches below upper seam 54 of body 24 and no greater than 14 inches below the upper seam 54 of body 24.

Pocket 232 comprise a first upper aperture 264 sized receive a round turkey slate or pot call and a second lower aperture 266 through a floor of pocket 232. Aperture 266 is smaller than aperture 264 and is sized to retain the call within pocket 232 yet large enough to receive a thumb or finger to facilitate pushing of the call from an underside of the pocket below the call with a person's thumb or fingers to eject the call out of the upper aperture 264. Aperture 264 facilitates quick removal of the call from pocket 232. In the example illustrated, the floor of pocket 232 is rounded to further inhibit snagging or catching of the call with the interior of pocket 232.

Hand warmer muff 236 comprises a cylinder of fur, thick fabric or insulative materials having two open ends 284 for receiving the hands of the person wearing garment 220. Hand warmer muff 236 is incorporated into pocket 134. In the example illustrated, hand warmer muff 236 is releasably attached to a remainder of garment 220 within the interior of pocket 134 (as shown by broken lines) by releasing fasteners such as hook and loop fasteners, snaps, hooks, buttons, zippers or other fasteners. As a result, hand warmer muff 236 may be removed in warmer temperatures or where sufficient heat is provided by a hand warmer held by hand warming packet carrier 238, providing greater space within pocket 134. In such an implementation, one of the portions of the hook and loop fasteners, snaps, hooks, buttons, zippers or the like are provided on a front or rear panel of pocket 134 within pocket 134. The other of the portions of the hook and loop fasteners, snaps, hooks, buttons, zippers or the like are provided on the exterior of muff 236. For example, muff 236 may include external fastening portions 286 which comprise a hook or loop portion, a snap portion, a button or buttonhole, or the like. In some implementations, the rear panel of pocket 134 may be the front of body 24. In other implementations, hand warmer muff 236 is sewn or otherwise fixedly attached to an interior surface of pocket 234. In some implementations, hand warmer muff 236 may be omitted.

Hand warming packet carrier 238, also referred to as a liner, comprises a pouch, sleeve, set of straps, pocket or the like incorporated into pocket 234 and configured to releasably hold or contain an hand warming packet carrying an actuatable heat releasing exothermic chemical composition. The exothermic chemical composition, upon being actuated, such as by bending the packet to break internal seals allowing chemicals to come into reaction contact with one another, exothermically reacts and releases heat. In the example illustrated, carrier 238 is releasably attached to a panel or surface within pocket 134 (as shown by broken lines), allowing carrier 238 to be removed from pocket 134 to facilitate easier insertion of a hand warming packet. In such an implementation, carrier 238 may be releasably attached or connected within the interior of pocket 134 by hook and loop fasteners, snaps, hooks, buttons, zippers or other fasteners. In other implementations, hand warming carrier 238 is sewn, welded, bonded or otherwise permanently fixed to a remainder of garment 220 within pocket 134. In some implementations, carrier 238 may be omitted.

Pot call striker peg holder 240 comprises a structure to hold or retain turkey pot call striker pegs 284 while providing quick and easy access to such striker pegs. Holder 240 is located on chest area 50 so as to not interfere with a shouldered firearm or archery (below or crossbow) and so as to not interfere with positioning of a firearm or a crossbow stock against a hunter's shoulder. In the example illustrated, the upper end of holder 240 is at least 3 inches below upper seam 54 of body 24 and no greater than 14 inches below the upper seam 54 of body 24.

In the example illustrated, holder 240 comprises one or more openings extending through at least a portion of body 24, were the openings are sized such that a first portion 286 may pass through such openings while a second larger portion 288 of pegs 284 may not pass through the opening. In one implementation, body 24 includes multiple layers comprising an outer layer and an inner layer, wherein portion 286 resides between the inner and outer layers. In one implementation, a pocket 290 having a floor 292 is formed between the inner and outer layers, wherein the pocket receives portion 286. In yet other implementations, holder 240 may comprise a loop or ring through which portion 286 passes, wherein portion 286 resides on the exterior of body 24. In some implementations, holder 240 may be omitted.

Garment 220 is especially well-suited for use in hunting and wildlife observation. When seated in a tree stand or within a blind, accessing pockets difficult. For example, when a person is within a blind, accessing pockets often requires reaching for gear on the ground or floor of the blind. Operating a weapon does not allow for equipment to be stored on areas of the body which could potentially be dangerous or hinder movement. Garment 220 addresses such problems of accessing gear such as rangefinder devices and different styles of turkey and animal calls—by positioning pockets on the lower chest area. This positioning does not interfere with safely shooting either a gun, bow, or crossbow weapon. The top third of the chest and shoulder area is void of any pockets so as not to block or prohibit shouldering a gun or crossbow or drawing or shooting a vertical archery bow. Gear pockets on the chest area, sleeves, and lower hand pockets are designed to be ergonomically positioned for easy reaching and access in a confined small space such as the ground blind or tree stand. In the example illustrated, garment 220 is designed to store gear in designated pockets for turkey friction call striker devices, friction calls which are traditionally flat and round, diaphragm mouth calls, and various rangefinder devices, gun cartridges, cellular phones, etc.

Garment 220 further enhances concealment or camouflaging of a person during hunting or wildlife observation. Garment 220 incorporates a facemask into the hood portion—so that the user can simply pull the mask over his or her face as a form of camouflage. The limited windows of the ground blind block out light so the black color of the garment is an effective camouflage for the dark interior of the blind.

Hunting and wildlife observation is often done in remote areas, requiring a person to manually carry his or her gear over large distances and across rough terrain. Garment 220 is convertible so as to serve as a carrier, bag or pack to facilitate such gear transport. In the example illustrated, garment 220 incorporates a zipper at the bottom of the garment which can be closed to form a type of bag or carrier in order to transport bulky equipment such as turkey decoys, extra clothing, garments, or gear. As hunting is generally done in colder weather, garment 220 is quiet and warm. As a hood pullover, garment 220 comprises a single piece article of clothing. When used in colder environments, garment 220 releasably secures a hand warmer muff and/or includes a liner or hand warming packet carrier containing a hand warmer packet.

Although garment 220 is illustrated in the context of a hunting garment used in hunting, especially when hunting wild file such as turkeys, garment 220 may be used for other on hunting or wildlife observation activities as well. In another implementation, garment 220 may be utilized for other purposes as well. For example, selected features may be used on pullover garments utilized during skiing or other outdoor activities. For example, facemask 230, and warmer muff 236, hand warming packet carrier 238 and waist opening closer 42 may be utilized in other pullover garments utilized during other outdoor activities such as skiing and the like. In such implementations, garment 220 may be provided with other outer colorings aside from black, dark colors and camouflage.

Although the present disclosure has been described with reference to example embodiments, workers skilled in the art will recognize that changes may be made in form and detail without departing from the spirit and scope of the defined subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A garment comprising:

a body having a waist area with a waist opening, a chest area with a head opening and an interior facing the wearer when worn on a torso of the wearer;

sleeves extending from the body; and a hood extending from the body about the head opening and having a face opening; and a waist opening closer on a lower portion of the waist area to retain opposite sides of the waist opening in contact so as to form a floor of a bag with the waist area of the body, wherein the body comprise a waist cuff, the waist cuff movable between an extended position extending below the waist opening closer and defining the waist opening, and a withdrawn position extending within the interior of the body when opposite sides of the waist opening are retained in contact so as to form the floor of the bag.

2. The garment of claim 1 further comprising a fastening mechanism to releasably connect end portions of the sleeves.

3. The garment of claim 2, the fastening mechanism comprises a male buckle secured to a first one of the sleeves and a female buckle secured to a second one of the sleeves.

4. The garment of claim 1, wherein the waist opening closer comprises a zipper mechanism.

5. The garment of claim 1, further comprising a facemask incorporated into and carried by the hood.

6. The garment of claim 5, wherein the facemask comprises a panel suspended from an upper portion of the hood.

7. The garment of claim 5, wherein the facemask comprises a panel connected to the garment below the face opening.

8. The garment of claim 7, wherein the facemask has an upper portion detachably connected to the hood proximate an upper edge of the face opening.

9. The garment of claim 5, wherein the facemask is movable between a first position across the face opening and a second position along a back of the hood.

10. The garment of claim 1 further comprising a double entry kangaroo pocket on the waist area of the body.

11. The garment of claim 10 further comprising a hand warming packet carrier incorporated into the kangaroo pocket to receive a hand warming packet.

12. The garment of claim 11, wherein the hand warming packet carrier is releasably attached to a remainder of the garment within an interior of the kangaroo pocket by one or more hook and loop fasteners, snaps, hooks, buttons, zippers or other fasteners.

13. The garment of claim 10 further comprising a hand receiving insulated hand warmer muff removably attached to a remainder of the garment within an interior of the kangaroo pocket.

14. The garment of claim 13, wherein the hand warmer muff is releasably attached to a remainder of the garment within an interior of the kangaroo pocket by one or more hook and loop fasteners, snaps, hooks, buttons, zippers or other fasteners.

15. The garment of claim 10 further comprising an upper pocket incorporated into the kangaroo pocket, the upper pocket opening along the top of the kangaroo pocket.

16. The garment of claim 10, wherein the upper pocket comprises a closing mechanism to open and close a top of the kangaroo pocket to facilitate access to the upper pocket and to facilitate access to an interior of the kangaroo pocket.

17. The garment of claim 1 further comprising a pot call striker peg holder on the chest area of the body.

18. The garment of claim 17, wherein a top of the pot call striker peg holder is at least 3 inches below an upper seam of the body that is to extend across along a hunter's shoulders and is no greater than 14 inches below the upper seam of the body.

19. The garment of claim 17, wherein the pot call striker peg holder comprise a sewn loop on an exterior of the body.

20. The garment of claim 17, wherein the body comprises an outer layer and an inner layer and wherein the pot call striker peg holder comprises a striker opening through the outer layer, the striker opening being sized such that a first portion of a pot call striker peg may pass through the opening into a space between the outer layer and the inner layer and such that a second larger portion of the pot call striker peg may not pass through the striker opening.

21. The garment of claim 17, wherein the body further comprises an interior striker pocket having a floor between the outer layer and the inner layer, the striker pocket to receive the first portion of the pot call striker peg.

22. The garment of claim 1, wherein the waist opening closer is selected from a group of closers consisting of: a zipper having rows of multiple interlocking teeth, a drawstring and a plastic zipper.

23. The garment of claim 1, wherein garment comprises a pullover garment and wherein each of the sleeves comprises a thumb hole proximate an outer end of the sleeve.

* * * * *